United States Patent [19]

Fasth

[11] 4,111,096

[45] Sep. 5, 1978

[54] FASTENING DEVICE

[75] Inventor: Ulf Kenneth Folke Fasth, Harplinge, Sweden

[73] Assignee: AB Fast-Devel, Harplinge, Sweden

[21] Appl. No.: 569,083

[22] Filed: Apr. 17, 1975

[30] Foreign Application Priority Data

Apr. 25, 1974 [SE] Sweden ..... 74056003

[51] Int. Cl.[2] ..... F16B 15/00

[52] U.S. Cl. ..... 85/11

[58] Field of Search ..... 85/11, 21; 248/300, 248/343, 71; 52/363

[56] References Cited

U.S. PATENT DOCUMENTS

| | | | |
|---|---|---|---|
| 988,090 | 3/1911 | Hamilton | 248/71 X |
| 2,382,474 | 8/1945 | Gambo | 85/11 |
| 2,386,887 | 10/1945 | Eckel | 85/11 |
| 2,580,231 | 12/1951 | Lamm | 248/300 X |
| 2,697,857 | 12/1954 | Eckel | 85/11 X |
| 2,913,204 | 11/1959 | Stewart | 85/11 X |
| 2,959,897 | 11/1960 | Baker | 85/11 X |
| 3,511,127 | 5/1970 | Gisodi | 85/11 |

FOREIGN PATENT DOCUMENTS

| | | | |
|---|---|---|---|
| 325,218 | 12/1957 | Switzerland | 248/71 |

*Primary Examiner*—Ramon S. Britts

*Attorney, Agent, or Firm*—Haseltine, Lake, & Waters

[57] ABSTRACT

A fastening device to be used for attaching or mounting boards, slabs or mats of a pierceable material, in particular insulation mats, on a support surface, as for instance walls, roofs, ventilation ducts, etc., comprises an elongated, relatively thin metal strip, which has a portion at its one end designed as a foot portion to be secured flat against the support surface for instance by means of a screw, a nail, a rivet, spot-welding or glueing. The metal strip is comparatively rigid against bending but is provided with a first transversal bending or folding line with a reduced resistance against bending, which is located between said foot portion at the one end of the strip and the remaining portion of the strip, and a second transversal bending or folding line with a reduced resistance against bending located closer to the opposite end of the strip spaced from the first bending or folding line by a distance corresponding to the thickness of the material to be attached to the support surface by means of the fastening device.

4 Claims, 18 Drawing Figures

FASTENING DEVICE

The invention is related to a fastening device to be used for attaching or fastening boards, slabs, mats or similar elements consisting of a pierceable material on a support surface. In particular the fastening device according to the invention is intended to be used for attaching an insulation material, as for instance mats, boards or slabs of mineral wood, on a support surface, as for instance walls, roofs, ventilation ducts, walls of storage tanks and similar surfaces.

Prior art fastening devices generally used for this purpose have been rather unsatisfactory, particularly in that they are complicated to use and in many connections give an unsatisfactory result. A fastening device widely used for this purpose consists of a knurled, corrugated or striated metal stud, which is welded with its one end to the support surface, which must consequently consist of metal, so as to jut out perpendicularly from the support surface. Thereafter the insulation mat or board is pressed against the support surface so that the pointed studs pierce the mat or board, whereafter securing washers are pushed onto the knurled, corrugated or striated ends of the studs projecting outside the insulation mat. Instead of such knurled, corrugated or striated studs one has previously also used in a similar manner thin metal strips provided with notches in the longitudinal edges for the securing washers. The use of these prior art studs or metal strips with cooperating securing washers for attaching insulation mats or boards on a support surface has involved the disadvantage that the pointed stud ends jut out from the outer side of the insulation, where they can easily scratch or tear the workers and further make it difficult to apply a facing panel or sheet on the outside of the insulation. In those cases when the insulation consists of two or several superimposed layers of insulation mats or boards, the prior art fastening devices give cause to an additional problem, as it may be necessary to use one array of fastening studs for each insulation layer, in which case special and rather complicated and time-wasting steps must be taken for securing the fastening studs for the outer layers of insulation, which studs must be secured to the outer ends of the fastening studs for the subjacent insulation layer by means of special connecting devices.

The primary object of the present invention is therefore to provide an improved fastening device for the purpose described in the opening paragraph of this specification. The fastening device according to the invention is primarily characterized in that it consists of an elongated, relatively thin strip of a comparatively rigid but ductile material, preferably metal, this strip having at its one end a foot portion designed for being secured flat against a support surface, for instance by means of screw, nail, rivet, spot-welding or glueing, and that this strip has a first transversal bending line with a reduced resistance against bending located between said foot portion and the remaining portion of the strip and a second transversal bending line with reduced resistance against bending located closer to the opposite end of the strip spaced from the first bending line by a distance corresponding to the thickness of the material to be attached to a support surface by means of the fastening device.

A fastening device according to the invention can be secured to a support surface in a very simple manner by many various methods, for instance by means of nails, screws, rivets, spot welding or glueing, dependent on what may be preferable with respect to the nature of the support surface. In its final mounted position the fastening device according to the invention does not jut out from the external surface of the insulation attached to the support surface by means of the fastening device and will therefore not give cause to any injuries or damages by scratching or tearing or constitute an obstacle to the application of a facing panel or sheet on the outside of the insulation. Quite on the contrary the outer ends of the fastening devices according to the invention will constitute excellent points of attachment for such a facing panel or sheet or for additional fastening devices according to the invention for holding an additional insulation layer superimposed upon the first insulation layer.

In the following the invention will be described more in detail with reference to the accompanying drawings, which illustrate by way of example some different forms of a fastening device according to the invention and the manner in which it is intended to be used. In the drawings.

Figure 4:
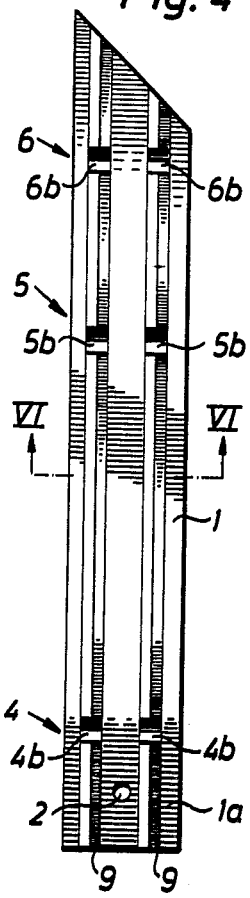
Figure 5:
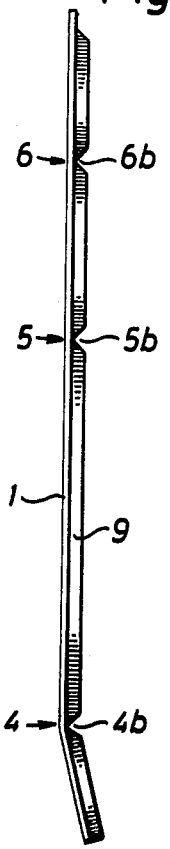
Figure 6:
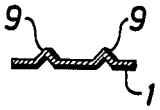
Figure 7:
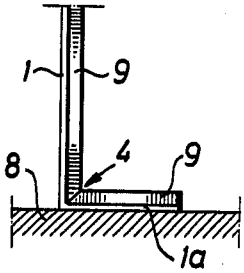
Figure 8:
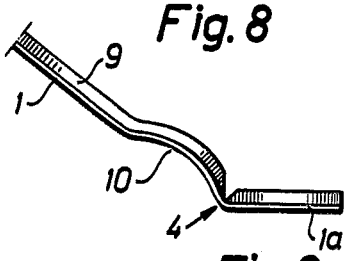
Figure 9:
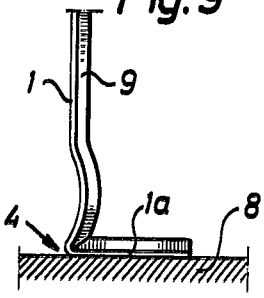
Figure 10:
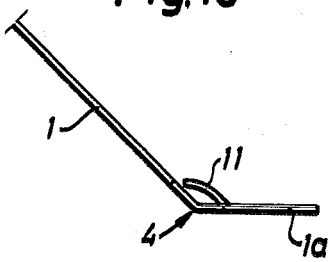
Figure 11:
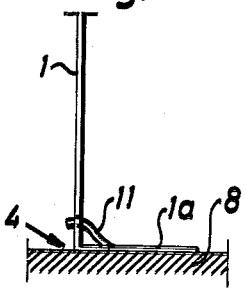
Figure 12:
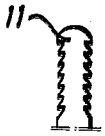
Figure 13:
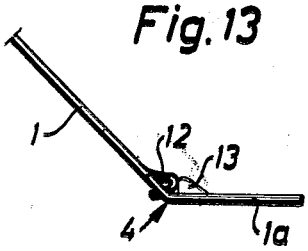
Figure 14:
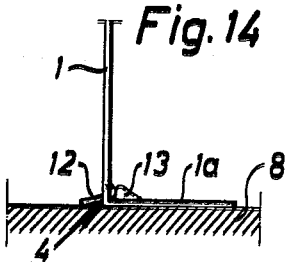

FIGS. 3*a* to 3*e* illustrate various stages of the operation when mounting an insulation mat on a support surface by means of fastening devices according to the invention;

FIG. 4 is a plan view of a second fastening device according to the invention;

FIG. 5 is a side view of the fastening device in FIG. 4;

FIG. 6 shows a cross-section of the fastening device in FIG. 4 along the line VI—VI;

FIG. 7 shows the lower portion of the fastening device in FIG. 4 to 6 when secured to a support surface;

FIGS. 8 and 9 are partial side views of a modification of the fastening device in FIGS. 4 to 7, shown in its original shape and after being secured to a support surface respectively;

FIGS. 10 and 11 are partial side views of another modified form of a fastening device according to the invention, shown in its original shape and after having been secured to a support surface respectively;

FIG. 12 illustrates a detail of the fastening device in FIGS. 10 and 11; and FIGS. 13 and 14 are side views of still another modification of a fastening device according to the invention, shown in its initial shape and after having been secured to a support surface respectively.

Figure 1:
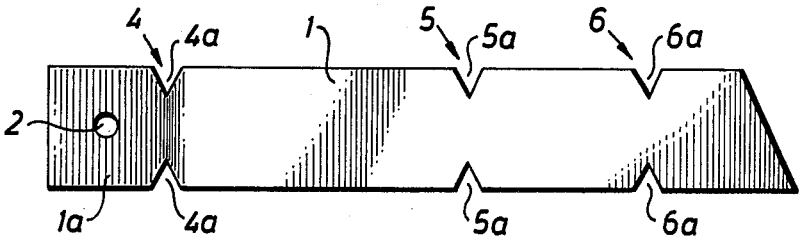
FIG. 1 is a plan view of a first fastening device according to the invention.
Figure 2:
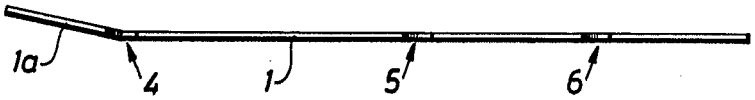
FIG. 2 is a side view of the fastening device in FIG. 1.

The fastening device according to the invention illustrated by way of example in FIGS. 1 and 2 consists of an elongated, relatively thin strip 1 of a relatively rigid but ductile and bendable material. Preferably the strip may consist of metal, as for instance galvanized sheet, steel sheet, aluminium, stainless sheet or similar material. At its one end the strip 1 has a portion 1*a*, which is intended to serve as a foot portion for securing the strip to the support surface, to which a board, slab or mat, as for instance an insulation mat, shall be attached. This foot portion 1*a* of the strip 1 is therefore preferably prepared in a suitable way for the securing of the foot portion to a support surface, for instance as illustrated in FIG. 1, where the foot portion 1*a* of the strip 1 is provided with an opening 2 for a nail, screw or rivet. Alternatively, the foot portion 1*a* of the strip 1 may be provided with a contact point or a contact surface for securing the foot portion to a support surface by means of spot welding. It is appreciated that the foot portion 1*a* of the strip 1 may be provided both with a hole 2 and such a contact point or contact surface for spot-welding so that any preferred method of securing the foot portion of the strip to a support surface can be used. The foot portion 1*a* of the strip may also be given a specific design for being secured to a support surface by means of glueing, for instance in that the foot portion is provided with a plurality of comparatively small openings in which the glue can get a firm grip.

The fastening device according to the invention illustrated in FIGS. 1 and 2 has three transversal bending lines, generally indicated by 4, 5, and 6, respectively, at which bending lines the strip has a reduced resistance against bending. In the embodiment of the invention illustrated in FIGS. 1 and 2 these transversal bending lines with a reduced resistance against bending are obtained by means of incisions or notches 4*a*, 5*a* and 6*a* respectively in the longitudinal edges of the strip. At each one of these transversal bending lines 4, 5, and 6 the strip may easily be bent, whereas at all other places over its length the strip is comparatively rigid against bending. The first transversal bending line 4 is located between the foot portion 1*a* of the strip and the remaining portion of the strip. The second transversal bending line 5 is located at a distance from the first bending line 4 corresponding to the thickness of the board, slab or mat of insulation material to be attached to a support surface by means of the fastening device. The third transversal bending line 6 is located between the second bending line 5 and the second end of the strip 1, which is preferably cut off at an angle so as to have a sharp point, either in the manner illustrated in the drawings or from both sides so as to have a symmetrical point.

As illustrated in FIG. 2, the strip 1 is slightly prebent, preferably already at its manufacture, at a small angle at the bending line 4 between the foot portion 1*a* of the strip and the remaining portion of the strip.

Figure 3A:
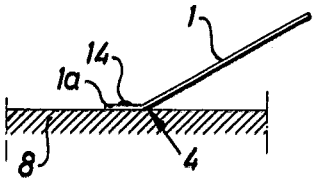
Figure 3B:
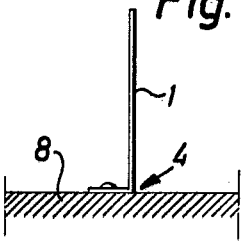
Figure 3C:
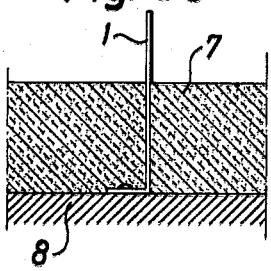
Figure 3D:
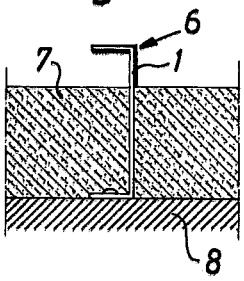
Figure 3E:
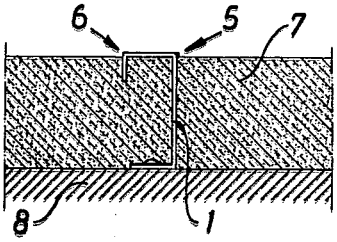

FIGS. 3*a* to 3*e* illustrate how a fastening device according to the invention, for instance designed in the manner illustrated in FIGS. 1 and 2, is used for attaching for instance an insulation mat 7 to a support surface 8. As shown in FIG. 3*a*, to begin with the foot portion 1*a* of the strip 1 is placed against the support surface 8 and secured thereto in a suitable manner, for instance by means of a rivet 14. This operation is facilitated by the pre-bending of the strip 1 at the bending line 4, as this makes it possible for the worker to hold the strip at its opposite end. Thereafter the strip 1 is bent at the bending line 4 to a perpendicular position relative to the support surface 8, as illustrated in FIG. 3*b*. Then the insulation mat 7 is pushed or pressed over the strip 1, as indicated in FIG. 3*c*, the sharp pointed end of the strip 1 easily piercing the insulation mat 7. Thereafter the strip 1 is bent at a right angle at the outer bending line 6, as shown in FIG. 3*d*, and subsequently also at the bending line 5, which is located substantially flush with the outer surface of the insulation mat, so that the outer sharp pointed end of the the strip is embedded in the insulation mat 7 in the manner illustrated in FIG. 3*e*.

It is appreciated that by using fastening devices according to the invention it is possible in a very simple manner to attach or mount the insulation mat 7 on the support surface 8 in a very secured manner. As several fastening devices 1 according to the invention are used for holding each insulation mat, these fastening devices 1 are preferably secured to the support surface 8 in such positions that some of them are bent in a first direction whereas the other fastening devices are bent in a second direction perpendicular to said first direction, whereby the mounting of the insulation mat 7 on the support surface 8 becomes very strong for shearing forces acting upon the insulation layer 7 in directions substantially parallel to the support surface 8.

It is appreciated that the fastening device 1 according to the invention has inter alia the important advantage that the method of securing the fastening device 1 to the support surface 8 can be selected at will dependent on the prevailing conditions, as for instance by means of nails, screws, rivets, welding or glueing. Further, the fastening device 1 according to the invention does not leave any projecting sharp points on the outside of the mounted insulation mat 7, which points could easily scratch or tear the workers and also obstruct the application of a facing panel or sheet on the outside of the insulation 7. On the contrary the portions of the fastening devices 1 located on the outside of the insulation mat 7, that is the portions between the bending lines 5 and 6, can in a very favourable manner serve as securing points for such a facing panel or sheet. These portions of the fastening devices can also serve as securing points for a second array of similar fastening devices used for holding a second layer of insulation material.

It is realized that it is not absolutely necessary that a fastening device according to the invention is provided with the third bending line 6. In the absence of this bending line, however, the outer pointed end of the fastening device will not become embedded in the insulation layer but will, after the bending at the bending line 5, lie flush on the outer side of the insulation layer. Such a modification of the fastening device will somewhat simplify the work when the fastening device is used for attaching the insulation layer on a support surface but has on the outer hand the disadvantage that the sharp pointed ends of the fastening devices will remain on the outside of the insulation layer, whereby they may under unlucky circumstances give cause to scratches or tears for the persons working with the installation.

The fastening device according to the invention, which is illustrated in FIGS. 4 to 7, differs from the fastening device illustrated in FIGS. 1 and 2 and described in the foregoing substantially only therein that the elongated thin strip 1, which preferably consists of metal, is provided with two longitudinal beads or grooves 9 which increase the bending rigidity of the strip 1. These beads or grooves may be produced for instance by means of a pressing operation. The transversal bending lines 4, 5, and 6 with a reduced resistance against bending of the strip are in this case created by interruptions 4*b*, 5*b*, and 6*b* respectively, in the longitudinal beads 9, whereby the strip 1 is substantially easier to bend at these bending lines 4, 5 and 6. Preferably, these interruptions 4*b*, 5*b*, and 6*b* in the longitudinal beads 9 are designed in such a manner that the end surfaces of the beads 9 facing each other at the interruptions are inclined at an angle of about 45° relative to the plane of the strip 1. In this way it is achieved, when the strip is bent at a bending line 4, 5 or 6 respectively, that the mutually facing end surfaces of the beads at the bending line will bear against each other when the strip 1 has been bent through 90°, whereby an improved stability and strength of the bend is achieved. This is illustrated in FIG. 7 for the bending line 4 of the strip 1, which has been secured to the support surface 8 with its foot portion 1*a* and subsequently bent to a position substantially perpendicular to the support surface.

It is appreciated that instead of using longitudinal beads as illustrated in FIGS. 4 to 7, and increased rigidity against bending of the strip can be obtained by providing the strip with longitudinal ribs or flanges along the longitudinal edges of the strip, in which case these ribs or flanges are provided with incisions or interruptions at the bending lines of the strip.

It is realized that for a fastening device according to the invention it is desired to obtain the best possible stability of the fastening device at its lower end which is secured to the support surface. Such an improved stability can be obtained for instance by the modified design of the fastening device illustrated in FIGS. 8 and 9. According to this modified design a portion 10 of the strip adjacent the bending line 4 is curved in the opposite direction to the intended direction of bending at the bending line 4, whereby the fastening device will have the shape illustrated in FIG. 9 when its foot portion 1*a* has been secured on the support surface 8 and the strip has been bent at the bending line 4 to a position substantially perpendicular to the support surface 8. This modified form of the fastening device provides an improved stability of the fastening device primarily against pressures perpendicular to the support surface 8.

Another modified design, which gives a similar improved stability, is illustrated in FIGS. 10, 11 and 12. According to this modification the strip 1, which for the sake of simplicity is shown without any reinforcing longitudinal beads, is provided with a tab 11 at the bending line 4, which tab 11 has been stamped out from the strip and bent up from the foot portion 1*a* of the strip, as illustrated in FIG. 10. When the strip 11 is bent at the bending line 4 to the position shown in FIG. 11, the free end of the tab 11 is inserted into a corresponding opening in the strip 1 on the opposite side of the bending line 4. The tab 11 is for instance serrated, as illustrated in FIG. 12, whereby it is automatically locked in the opening in the strip 1 and thereby retains this in a perpendicular position relative to the support surface 8.

Still another modified design, which provides a similar improved stability, is illustrated in FIGS. 13 and 14. According to this modification the strip 1 is provided with a stamped and bent tab 12 on the one side of the bending line 4, whereas the foot portion 1*a* on the opposite side of the bending line 4 is provided with a raised portion or wart 13, which is pressed out from the foot portion 1*a* of the strip 1 and which cooperates with the tab 12 in the manner illustrated in FIG. 14 when the strip 1 is bent at a right angle at the bending line 4.

It is appreciated that also many other modifications and variations of a fastening device according to the invention are possible within the scope of the invention.

What is claimed is:

1. A fastening device for fastening a layer of pierceable material, in particular an insulation material, on a support surface, comprising a single elongated and substantially thin strip of a relatively rigid but bendable material, said strip having a substantially constant width over its length and having at least one longitudinal reinforcement element extending over the length of the strip and imparting an increased rigidity against bending to the strip, a first relatively smaller portion of the strip adjacent one end thereof for being secured flush to said support surface, a first transverse bending line along which the strip has a reduced resistance to bending, said first transverse bending line being located between said first portion and the remaining portion of the strip, a second transverse bending line along which the strip has a reduced resistance to bending, said second transverse bending line being located along the strip between said first bending line and the opposite end of the strip spaced from said first bending line by a distance corresponding to the thickness of the layer to be fastened on the support surface, said first and second bending lines being comprised of interruptions in said longitudinal reinforcement element; a third transverse bending line along which the strip has reduced resistance to bending and located between said second bending line and said opposite end of the strip and spaced from said second bending line, said third transverse bending line being comprised of additional interruptions in said reinforcement element, the end surfaces of said reinforcement element at said interruptions at said bending lines being inclined at an angle of substantially 45° to the plane of the strip so that the end surfaces of the element facing each other at opposite sides of the interruption in the element at a bending line bear against each other and prevent continued bending when the strip has been bent through substantially 90° at said bending line, self-locking retaining means at said first bending line for locking the strip in a light-angled position at said bending line, a portion of the strip adjacent said first bending line on the side thereof opposite to said first portion of the strip being slightly curved in the opposite direction to the direction of the intended bending of the strip at said first bending line, said opposite end of the strip being cut off at an angle to a sharp point.

2. A fastening device for fastening a layer of pierceable material, in particular an insulation material, on a support surface, comprising a single elongated and substantially thin strip of a relatively rigid but bendable material, said strip having a substantially constant width over its length and having at least one longitudinal reinforcement element extending over the length of the strip and imparting an increased rigidity against bending to the strip, a first relatively smaller portion of the strip adjacent one end thereof for being secured flush to said support surface, a first transverse bending line along which the strip has a reduced resistance to bending, said first transverse bending line located between said first portion and the remaining portion of the strip, a second transverse bending line along which the strip has a reduced resistance to bending, said second transverse bending line being located along the strip between said first bending line and the opposite end of the strip spaced from said first bending line by a distance corresponding to the thickness of the layer to be fastened on the support surface, said first and second bending lines being comprised of interruptions in said longitudinal reinforcement element, the end surfaces of said reinforcement element at said interruptions at said bending lines being inclined at an angle of substantially 45° to the plane of the strip so the end surfaces of the element facing each other at opposite sides of the interruption in the element at a bending line bear against each other and prevent continued bending when the strip has been sent through substantially 90° at said bending line.

3. A fastening device for fastening a layer of pierceable material, in particular an insulation material, on a support surface, comprising a single elongated and substantially thin strip of a relatively rigid but bendable material, said strip having a substantially constant width over its length and having at least one longitudinal reinforcement element extending over the length of the strip and imparting an increased rigidity against bending to the strip, a first relatively smaller portion of the strip adjacent one end thereof for being secured flush to said support surface, a first transverse bending line along which the strip has a reduced resistance to bending, said first transverse bending line located between said first portion and the remaining portion of the strip, a second transverse bending line along which the strip has a reduced resistance to bending, said second transverse bending line being located along the strip between said first bending line and the opposite end of the strip spaced from said first bending line by a distance corresponding to the thickness of the layer to be fastened on the support surface, said first and second bending lines being comprised of interruptions in said longitudinal reinforcement element; self-locking retaining means at said first bending line for locking the strip in a light-angled position when being bent at said bending line.

4. A fastening device for fastening a layer of pierceable material, in particular an insulation material, on a support surface, comprising a single elongated and substantially thin strip of a relatively rigid but bendable material, said strip having a substantially constant width over its length and having at least one longitudinal reinforcement element extending over the length of the strip and imparting an increased rigidity against bending to the strip, a first relatively smaller portion of the strip adjacent one end thereof for being secured flush to said support surface, a first transverse bending line along which the strip has a reduced resistance to bending, said first transverse bending line located between said first portion and the remaining portion of the strip, a second transverse bending line along which the strip has a reduced resistance to bending, said second transverse bending line being located along the strip between said first bending line and the opposite end of the strip spaced from said first bending line by a distance corresponding to the thickness of the layer to be fastened on the support surface, said first and second bending lines being comprised of interruptions in said longitudinal reinforcement element; a portion of the strip adjacent said first bending line on the side thereof opposite to said first portion of the strip is slightly curved in the opposite direction to the direction of the intended bending of the strip at said first bending line.

* * * * *